US007037244B2

(12) United States Patent
Svihra et al.

(10) Patent No.: US 7,037,244 B2
(45) Date of Patent: May 2, 2006

(54) THERAPEUTIC ARM EXERCISE DEVICE

(76) Inventors: Robert John Svihra, 420 Ashwood Rd., Darlington, PA (US) 16115; Ronald Henry Cardinale, 829 Cottonwood Dr., Monroeville, PA (US) 15146

( * ) Notice: Subject to any disclaimer, the term of this patent is extended or adjusted under 35 U.S.C. 154(b) by 180 days.

(21) Appl. No.: 10/457,301

(22) Filed: Jun. 9, 2003

(65) Prior Publication Data

US 2004/0248712 A1 Dec. 9, 2004

(51) Int. Cl.
*A63B 21/06* (2006.01)

(52) U.S. Cl. ..... 482/93; 482/98; 482/135

(58) Field of Classification Search ..... 482/37, 482/44–48, 92, 93, 98, 101, 114, 148, 106, 482/135, 907; 601/23, 33
See application file for complete search history.

(56) References Cited

U.S. PATENT DOCUMENTS

| | | | | | |
|---|---|---|---|---|---|
| 2,783,045 | A * | 2/1957 | Bosch | 482/96 |
| 2,823,918 | A * | 2/1958 | Lewis | 482/148 |
| 3,364,747 | A * | 1/1968 | Ebstein | 73/379.01 |
| 3,866,914 | A * | 2/1975 | Jackson | 473/438 |
| 4,243,219 | A * | 1/1981 | Price | 482/103 |
| 4,465,275 | A * | 8/1984 | Lingelbach | 482/98 |
| 5,056,777 | A | 10/1991 | Capjon et al. | |
| 5,195,937 | A | 3/1993 | Engel et al. | |
| 5,241,952 | A | 9/1993 | Ortiz | |
| 5,254,066 | A * | 10/1993 | Brown et al. | 482/137 |
| 5,316,535 | A | 5/1994 | Bradbury | |
| 5,441,255 | A * | 8/1995 | Verbick | 473/55 |
| 6,659,920 | B1 * | 12/2003 | Kurz | 482/121 |
| 2003/0207739 | A1 * | 11/2003 | Whitall et al. | 482/92 |

* cited by examiner

*Primary Examiner*—Stephen R. Crow
*Assistant Examiner*—Tam Nguyen
(74) *Attorney, Agent, or Firm*—Carothers and Carothers

(57) ABSTRACT

A therapeutic arm exercise device which includes a vertical supporting frame for mounting on a vertical wall surface. An upright elongated exercise base board is pivotally secured relative to the frame for selectively positioning and retaining the board at different angles from vertical to less than vertical. An elongated track is provided on the outer surface of the board and a weight slide is slidably received on this track and is provided with a handle whereby a patient may manually slide the slide up and down along the track for rehabilitation exercise. In addition, the vertical position of the device may be adjusted on the wall. Also, the amount of weight for the slide may be adjusted. Indicia is provided on the board adjacent the track for indicating distance that the slide is moved by the patient upwardly along the track and a biofeedback annunciator is also provided to indicate attainment of a goal distance of upward movement along the track by the slide. A finger ladder is also provided on the outer surface of the board for finger climbing exercises.

6 Claims, 3 Drawing Sheets

THERAPEUTIC ARM EXERCISE DEVICE

FIELD OF THE INVENTION

This invention relates in general to arm exercise devices, and in particular to therapeutic exercise devices that are used to rehabilitate and improve range of motion of the upper extremities.

BACKGROUND OF THE INVENTION

Therapeutic range-of-motion exercise devices are provided as a means for which a person suffering from any weakness, stiffness, or debilitation of an arm or shoulder can practice range-of-motion exercises for rehabilitation. For example, typically after injury such exercises are carried out both in the hospital before release and thereafter as ongoing therapy for rehabilitation. An example of such equipment is illustrated in U.S. Pat. No. 5,241,952 entitled THERAPEUTIC RANGE-OF-MOTION EXERCISE DEVICE.

It is a principal object of the present invention to provide such an exercise device which is both inexpensive to manufacture, versatile in its use and application, and easy to utilize and adjust to different patient requirements.

SUMMARY OF THE INVENTION

The therapeutic arm exercise device of the present invention includes a vertical supporting frame for mounting on a vertical surface or wall and an upright elongated exercise base board pivotally secured relative to this frame for selectively positioning and retaining the board at different angles from vertical to less than vertical. An elongated track is provided on the outer surface of the board and a weight slide is slidably received on this track for movement up and down along the elongated board. A handle is provide for manually grasping and sliding the slide up and down along the track.

In order to accommodate patients either in a standing or sitting position, such as from a wheel chair, the therapeutic arm exercise device of the present invention also includes means for adjusting the vertical position of the mounting frame. In addition, means is provided for adjusting the weight of the slide. This is accomplished by permitting the addition or removal of small weights onto the slide.

Indicia is provided on the outer surface of the board adjacent the track for indicating distance the slide is moved upwardly by the patient along the track. In order to provide biofeedback, an adjustable annunciator is also provided adjacent the track for announcing attainment of a goal distance for upward movement of the slide on the track. This is provided in the form of a magnetic detection switch wherein a limit magnet to be detected may be moved and placed anywhere along the indicia for indicating distance adjacent to the slide, whereby when the slide is moved upwardly along the track to the elevation of the limit magnet a signal is electronically generated. This provides an audio signal which is heard when the patient reaches the elevation prescribed by the therapists.

In typical application, increased resistance is accomplished by adding generally up to four pounds in weights onto the slide, and the exercises can be carried out on the device of the present invention at angles of vertical or less than vertical, and typically at angles of 40 and 60 degrees.

A finger ladder is also provided on the outer surface of the base board whereby the patient can initiate therapeutic arm exercises by climbing the finger ladder with the fingers of the injured arm.

BRIEF DESCRIPTION OF THE DRAWINGS

Other objects and advantages appear hereinafter in the following description and claims. The accompanying drawings show, for the purpose of exemplification, without limiting the invention or appended claims, certain practical embodiments of the present invention wherein:

DETAILED DESCRIPTION OF THE PREFERRED EMBODIMENT

Figure 1:
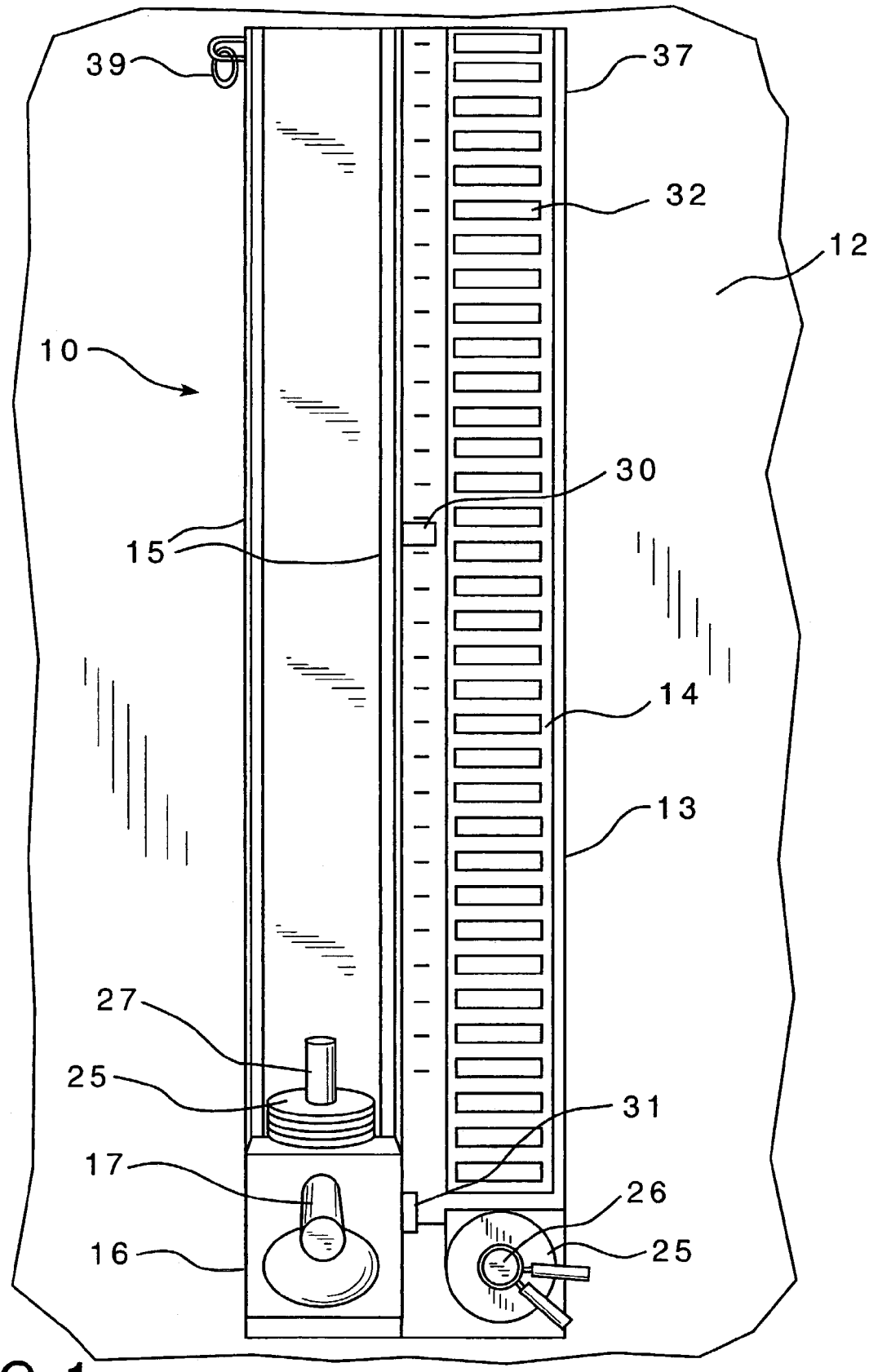
FIG. 1 is a front view of the therapeutic arm exercise device of the present invention.

Referring to the drawings, the therapeutic arm exercise device 10 of the present invention includes a vertical supporting frame 11 for mounting the device on a vertical wall surface 12. The device includes an upright elongated exercise base board 13 having an outer surface 14. The elongated board 13 is pivotally secured relative to frame 11 for selectively positioning and retaining the board at different angles from vertical to less than vertical. In FIGS. 1 and 3, the board is illustrated in a vertical position, and in FIG. 2, the board 13 is illustrated as being suspended at a 40 degree angle from horizontal. The board illustrated is also adjustable to be positioned at an angle of 60 degrees from horizontal.

An elongated track 15 is provided on the outer surface 14 of the board and weight slide 16 is slidably received on the dual track 15. Weight slide 16 is provided with a handle 17 for grasping and manually sliding the slide 16 up and down along track 15.

As is best seen in FIG. 3, the frame 11 includes means for adjusting the vertical position of the frame on wall 12. This is to accommodate patients of different height and to also accommodate patients in a seated position, for example, as seated in a wheelchair, so that they can properly grasp the handle 17 of slide 16 and move the slide upwardly along track 15. To accomplish this, frame 11 is provided in two parts, one part 20 is secured to the back side 18 of board 13 and the other portion 21 of frame 11 is secured to the vertical wall 12. A spring loaded pin 22 is mounted on a vertical slide bar 23 of frame portion 20 and may be pulled out to disengage from selected spaced openings (not shown), in slide channel 24 which is part of frame portion 21 and receives slide bar 23 therein for vertical sliding in fixed guide channel 24. When spring bias pin 22 is pulled outwardly against the bias of its spring, the slide bar 23 along with the exercise device 10 may be slid upwardly or downwardly along slide guide channel 24 until the desired vertical position is attained. At this point, spring biased pin 22 is released to engage in a corresponding opening (not shown) in the back of vertical guide channel 24 to retain the entire exercise device 10 in the selected vertical position.

The device 10 includes means for adjusting the weight of the slide. This is accomplished by the use of one pound barbell weights 25 which may be stored on pin 26 on the outer surface 14 of board 13, and transferred as desired to pin 27 on slide 16.

Indicia 28 is provided on the outer surface 14 of board 13 for indicating distance in inches that slide 16 is moved upwardly along track 15.

An adjustable annunciator is also provided adjacent track 15 for announcing attainment of a goal distance for upward movement of the slide on the track as attained by the patient and prescribed by the therapist. The details of this annunciator are not shown as it is a well known device which operates through use of magnetic sensing switches. One part of this annunciator includes a moveable magnetic limit strip 30 which may be picked up and moved by the therapist along indicia scale 28 and placed at any position desired there along. Strip 30 is of magnetic material and will stick to this metal indicia strip 28 when so positioned.

A corresponding magnetic switch 31 is provided on the housing of slide 16 whereby when slide 16 is moved upwardly so that magnetic switch 31 attains the height of prepositioned magnetic limit strip 30, magnetic switch 31 detects the magnet 30 and the switch thereof closes and closes a battery operated circuit (not shown) contained inside of housing 16 which energizes an audio annunciator or signal in a known manner.

A finger ladder 32 is also provided on the outer surface 14 of board 13 whereby the patient may conduct exercises by climbing this ladder with the fingers of the injured arm which requires rehabilitation.

The elongated board 13 is pivoted at a fixed position on its backside 18 to short support board 35. In turn, support board 35 is pivoted at its bottom end 36 to the bottom end of frame 11.

The upper end 37 of elongated board 13 has two opposed outwardly extending protrusions (not shown) which ride inside of the respective L-channels 38 so that the upper end 37 of board 13 may slide up and down the frame 11 and such sliding movement is guided by the tracks provided by opposed L-shaped channels 38. This of course permits the angling of elongated board 13 from any position from vertical to less than vertical.

Figure 2:
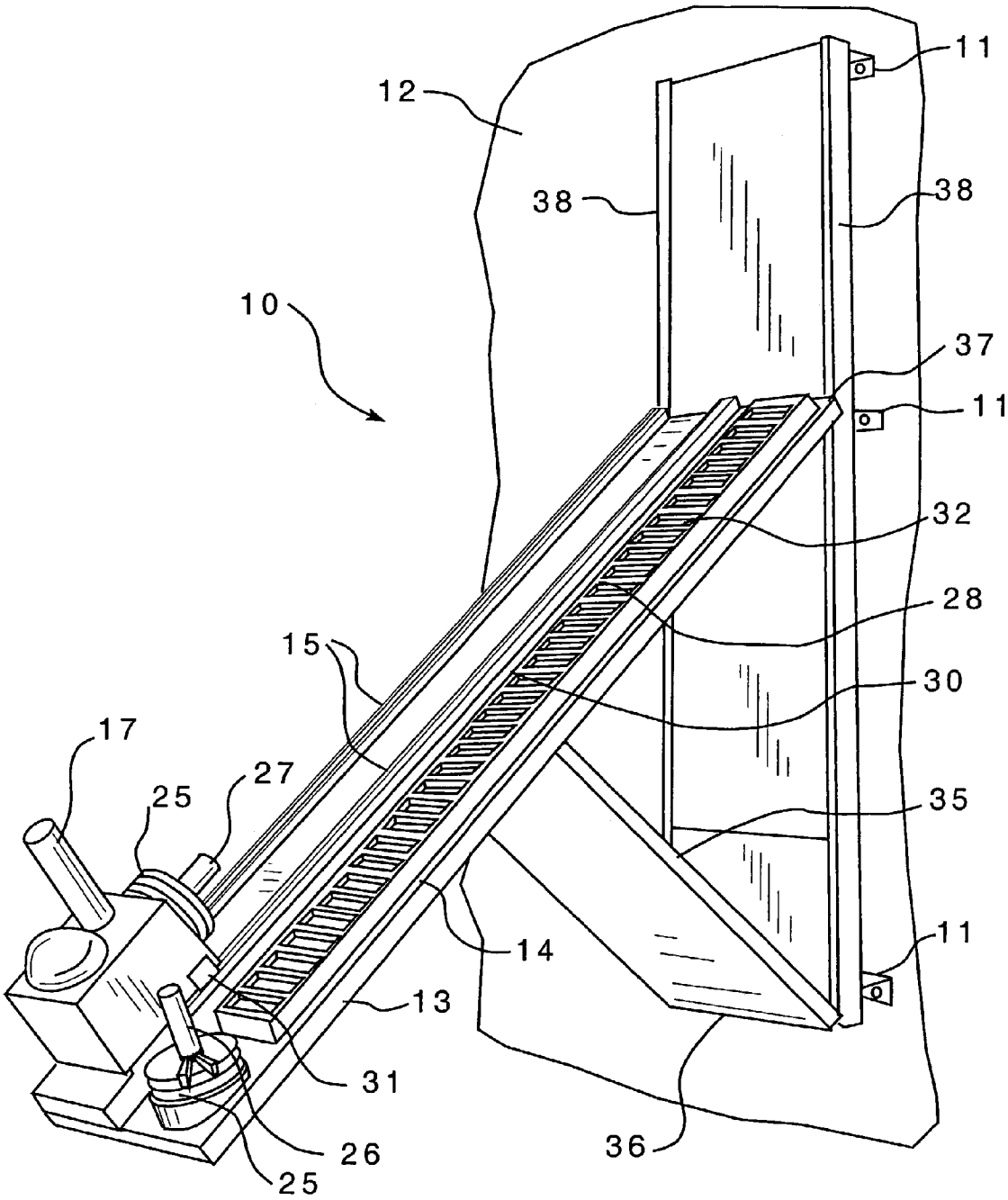
FIG. 2 is a perspective view of the therapeutic arm exercise device of the present invention shown in an adjusted position of 40 degrees from horizontal.
Figure 3:
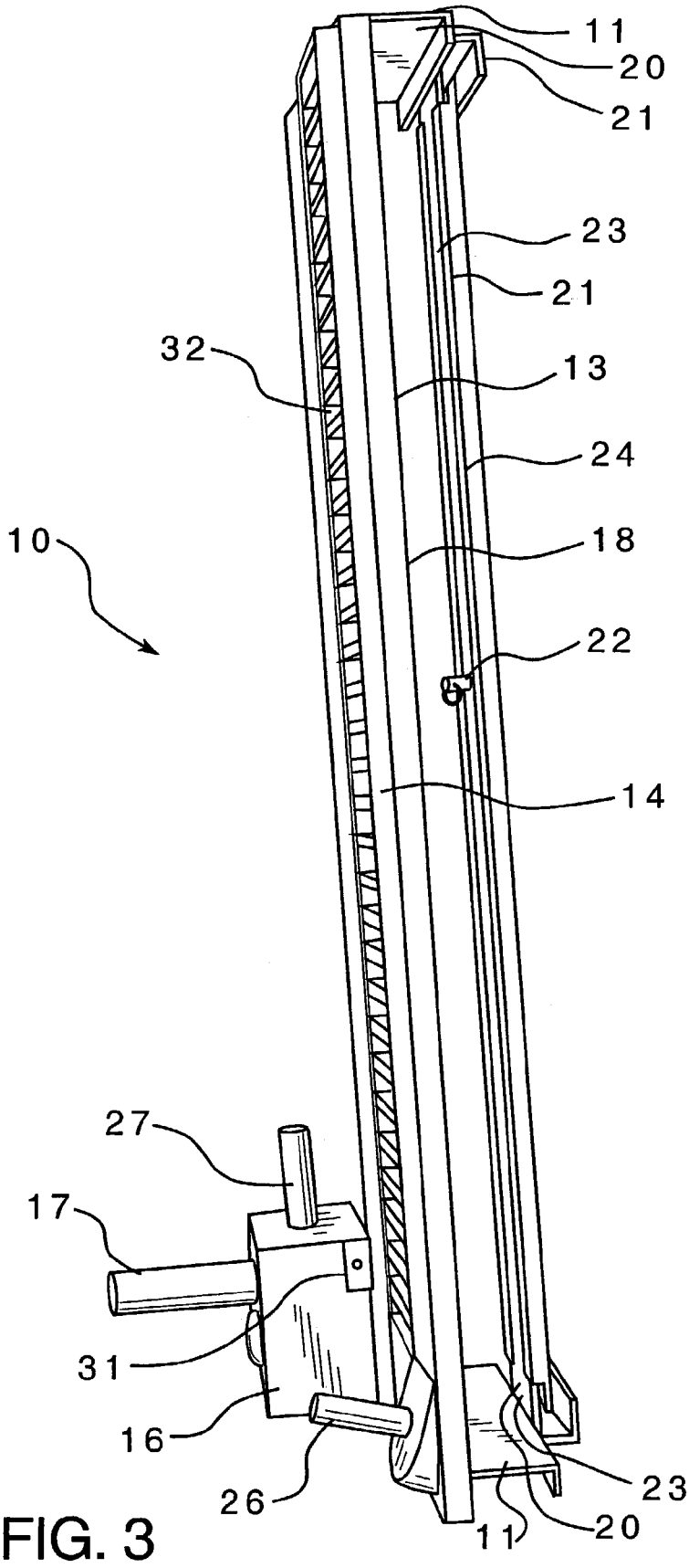
FIG. 3 is a right side view of the device illustrated in FIG. 1 shown in perspective.

The particular device 10 illustrated is provided with a spring loaded locking pin 39 at the upper left hand end of elongated base board 13 which locks into pre-located openings (not shown) in the left hand L-shaped channel of the L-shaped channels 38 whereby the elongated board 13 may be locked relative to frame 11 either at an angle of 40 degrees from horizontal as illustrated in FIG. 2 or at an angle of 60 degrees relative to horizontal (not shown).

The invention claimed is:

1. A therapeutic arm exercise device comprising:

an elongated supporting frame;

means for securing said frame to a vertical surface such as a door or a wall with its direction of elongation extending vertically;

an upright elongated exercise base board pivotally secured relative to said frame for selectively positioning and retaining said base board at different angles from vertical to less than vertical;

an elongated track on an outer surface of said base board; a weight slide slidably received on said track and having a handle for manually sliding said slide up and down said track; and a support board having top and bottom ends with said top end pivotally secured to a fixed position of an inside surface of said base board intermediate upper and lower ends thereof, said bottom end of said support board pivotally secured to a bottom end of said frame, and an upper end of said base board adjustably securable to said frame at different vertical positions.

2. The therapeutic arm exercise device of claim 1, including means for adjusting the vertical position of said frame.

3. The therapeutic arm exercise deivce of claim 1, including means for adjusting the weight of said slide.

4. The therapeutic arm exercise device of claim 3, including indicia on said outer surface of said board adjacent said track for indicating distance said slide is moved upwardly along said track.

5. The therapeutic arm exercise device of claim 4, including adjustable annunciator means adjacent said track for announcing attainment of a goal distance for upward movement of said slide on said track.

6. The therapeutic arm exercise device of claim 1, including a finger ladder on said outer surface of said baseboard.

* * * * *